US011441405B2

(12) United States Patent
Madasu et al.

(10) Patent No.: US 11,441,405 B2
(45) Date of Patent: Sep. 13, 2022

(54) REAL-TIME DIVERSION CONTROL FOR STIMULATION TREATMENTS USING TORTUOSITY AND STEP-DOWN ANALYSIS

(71) Applicant: Halliburton Energy Services, Inc., Houston, TX (US)

(72) Inventors: Srinath Madasu, Houston, TX (US); Geoffrey W. Gullickson, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 672 days.

(21) Appl. No.: 16/325,702

(22) PCT Filed: Sep. 9, 2016

(86) PCT No.: PCT/US2016/050976
§ 371 (c)(1),
(2) Date: Feb. 14, 2019

(87) PCT Pub. No.: WO2018/048415
PCT Pub. Date: Mar. 15, 2018

(65) Prior Publication Data

US 2021/0332684 A1 Oct. 28, 2021

(51) Int. Cl.
*E21B 43/267* (2006.01)
*E21B 47/06* (2012.01)
*E21B 49/08* (2006.01)

(52) U.S. Cl.
CPC ..... *E21B 43/267* (2013.01); *E21B 47/06* (2013.01); *E21B 49/087* (2013.01); *E21B 2200/20* (2020.05); *E21B 2200/22* (2020.05)

(58) Field of Classification Search
CPC ..... E21B 43/267; E21B 47/06; E21B 49/087; E21B 2200/20; E21B 2200/22
See application file for complete search history.

(56) References Cited

U.S. PATENT DOCUMENTS 9,135,475 B2 9/2015 Lecerf et al.
2002/0007949 A1 1/2002 Tolman et al.
(Continued)

FOREIGN PATENT DOCUMENTS

WO WO-2013085479 A1 6/2013

OTHER PUBLICATIONS

Korean Intellectual Property Office, International Search Report and Written Opinion, PCT/US2016/050976, dated Jun. 1, 2017, 20 pages, Korea.

(Continued)

*Primary Examiner* — Crystal J. Lee
(74) *Attorney, Agent, or Firm* — Haynes and Boone, LLP

(57) ABSTRACT

System and methods of controlling diversion for stimulation treatments in real time are provided. Input parameters are determined for a stimulation treatment being performed along a wellbore within a subsurface formation. The input parameters include selected treatment design parameters and formation parameters. A step-down analysis is performed to identify friction components of a total fracture entry friction affecting near-wellbore pressure loss during the stimulation treatment. Efficiency parameters are determined for a diversion phase of the stimulation treatment to be performed along a portion of the wellbore, based on the input parameters and the friction components. An amount of diverter to be injected during the diversion phase of the stimulation treatment is calculated based at least partly on the efficiency parameters. The diversion phase of the stimulation treatment is performed by injecting the calculated amount of diverter into the subsurface formation via perforations along the portion of the wellbore.

20 Claims, 8 Drawing Sheets

(56) References Cited

U.S. PATENT DOCUMENTS

| | | | | |
|---|---|---|---|---|
| 2005/0178551 | A1 | 8/2005 | Tolman et al. | |
| 2006/0021753 | A1* | 2/2006 | Wilkinson | E21B 43/26 166/308.1 |
| 2007/0095528 | A1* | 5/2007 | Ziauddin | G01F 1/7086 166/252.3 |

OTHER PUBLICATIONS

J. Romero, M.G. Mack and J. L. Elbel, Theoretical Model and Numerical Investigation of Near-Wellbore Effects in Hydraulic Fracturing, SPE 30506, Oct. 22-25, 1995, 10 pages, SPE Annual Conference & Exhibition, Dallas, Texas U.S.A.

Leon V. Massaras, Alexanndru Dragomir and Daniel Chiriac, Enhanced Fracture Entry Friction Analysis of the Rate Step-Down Test, SPE 106058, Jan. 29-31, 2007, 16 pages, SPE Hydraulic Fracturing Technology Conference, College Station, Texas U.S.A.

Michael Szatny, Enabling Automated Workflows for Production, SPE 109859, Nov. 11-14, 2007, 4 pages, SPE Annual Technical Conference and Exhibition held in Anaheim, California.

M. M. Rahman and M. K. Rahman, A Review of Hydraulic Fracture Models and Development of an Improved Pseudo-3D Model for Stimulating Tight Oil/Gas Sand, 23 pages, 2010, Taylor & Francis Group, LLC, Energy Sources, Part A.

Maciej Matyka and Zbigniew Koza, Howto Calculate Tortuosity Easily?, Mar. 26, 2012, 6 pages, Ministry of Science and Higher Education.

Nimish Pandya and Omkar Jaripatke, Rate Step-Down Analysis Improves Placement Efficiency of Stimulation Treatments in Unconventional Resource Play, SPE 1943637, Aug. 25-27, 2014, 10 pages, Unconventional Resources Technology Conference, Denver, Colorado.

* cited by examiner

REAL-TIME DIVERSION CONTROL FOR STIMULATION TREATMENTS USING TORTUOSITY AND STEP-DOWN ANALYSIS

CROSS-REFERENCE TO RELATED APPLICATIONS

This application is a U.S. national stage patent application of International Patent Application No. PCT/US2016/050976, filed on Sep. 9, 2016, the benefit of which is claimed and the disclosure of which is incorporated herein by reference in its entirety.

FIELD OF THE DISCLOSURE

The present disclosure relates generally to downhole fluid injection treatments for stimulating hydrocarbon production from subsurface reservoirs, and particularly, to techniques for controlling the placement and distribution of injected fluids using diverting agents during such stimulation treatments.

BACKGROUND

In the oil and gas industry, a well that is not producing as expected may need stimulation to increase the production of subsurface hydrocarbon deposits, such as oil and natural gas. Hydraulic fracturing is a type of stimulation treatment that has long been used for well stimulation in unconventional reservoirs. A multistage stimulation treatment operation may involve drilling a horizontal wellbore and injecting treatment fluid into a surrounding formation in multiple stages via a series of perforations or formation entry points along a path of a wellbore through the formation. During each of the stimulation treatment, different types of fracturing fluids, proppant materials (e.g., sand), additives and/or other materials may be pumped into the formation via the entry points or perforations at high pressures to initiate and propagate fractures within the formation to a desired extent. With advancements in horizontal well drilling and multi-stage hydraulic fracturing of unconventional reservoirs, there is a greater need for ways to accurately monitor the downhole flow and distribution of injected fluids across different perforation clusters and efficiently deliver treatment fluid into the subsurface formation.

Diversion is a technique used in injection treatments to facilitate uniform distribution of treatment fluid over each stage of the treatment. Diversion may involve the delivery of a diverting agent into the wellbore to divert injected treatment fluids toward formation entry points along the wellbore path that are receiving inadequate treatment. Examples of different diverting agents include, but are not limited to, viscous foams, particulates, gels, benzoic acid and other chemical diverters. Traditionally, operational decisions related to the use of diversion technology for a given treatment stage, including when and how much diverter is used, are made a priori according to a predefined treatment schedule. However, such conventional diversion techniques fail to account for downhole and near-wellbore operating conditions that may affect the downhole flow distribution of the treatment fluid during the actual stimulation treatment.

DESCRIPTION OF ILLUSTRATIVE EMBODIMENTS

Figure 1:
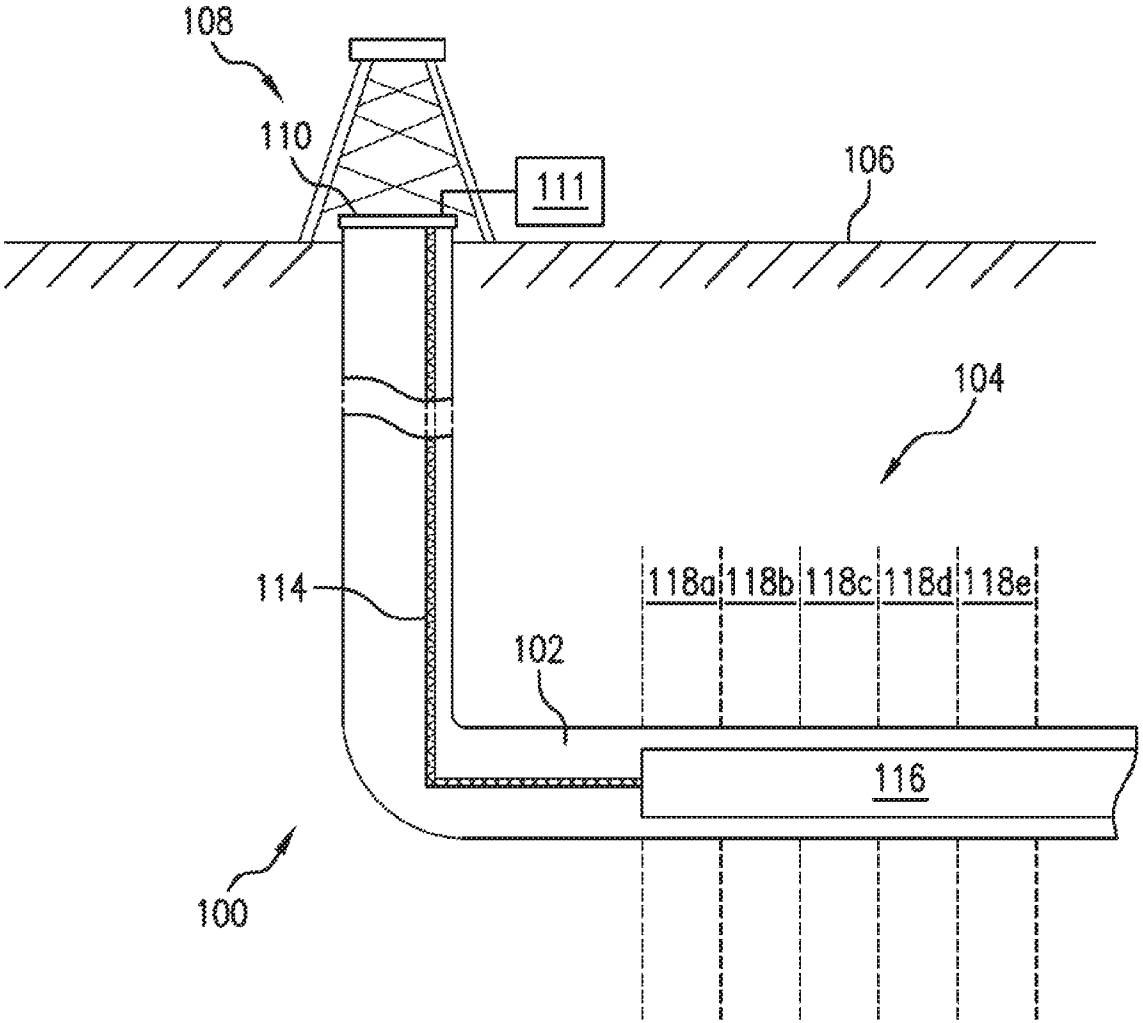
FIG. 1 is a diagram of an illustrative well system for performing a multistage stimulation treatment within a hydrocarbon reservoir formation.

Embodiments of the present disclosure relate to controlling diverter injection during stimulation treatments in real time using tortuosity and step-down analysis. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to implement such feature, structure, or characteristic in connection with other embodiments whether or not explicitly described.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

As will be described in further detail below, embodiments of the present disclosure may be used to make real-time operational decisions regarding the use of diversion to control the distribution of treatment fluid injected into a subsurface hydrocarbon reservoir formation during a stimulation treatment. For example, the stimulation treatment may involve injecting treatment fluid into the subsurface formation via formation entry points (or "perforation clusters") along a wellbore drilled within the formation. The treatment fluid may be injected via the formation entry points over a plurality of treatment cycles during each stage of the stimulation treatment. A more uniform distribution of the injected treatment fluid has been shown to increase the coverage of the stimulation treatment along the wellbore and thereby, improve hydrocarbon recovery from the formation. To improve the distribution of the injected treatment fluid across the various formation entry points or perforation clusters, a diverting agent (or "diverter") may be injected into the wellbore during a diversion phase of the treatment between consecutive treatment cycles. The amount of diverter that is injected during the treatment may impact the flow distribution and perforation cluster efficiency. For example, the flow distribution and perforation cluster efficiency may be improved by using an appropriate amount of diverter to effectively plug certain formation entry points or perforation clusters along the wellbore path and thereby divert the injected fluid toward other formation entry points receiving inadequate treatment.

In one or more embodiments, an optimal amount of diverter to be injected during a diversion phase of the stimulation treatment may be determined in real time using tortuosity and step-down analysis. The real-time analysis techniques disclosed herein may allow, for example, a well operator to obtain accurate estimates of the diverter amount relatively quickly while the treatment is in progress. This also allows the wellsite operator to perform the treatment in an efficient manner and avoid injecting either an excess or insufficient amount of diverter into the wellbore, which in turn reduces the overall costs of the treatment and the chances of performing an inefficient diversion.

Illustrative embodiments and related methodologies of the present disclosure are described below in reference to the examples shown in FIGS. 1-6 as they might be employed, for example, in a computer system for real-time analysis and control of diverter injection during stimulation treatments. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented. While these examples may be described in the context of a multistage hydraulic fracturing treatment, it should be appreciated that the real-time flow distribution monitoring and diversion control techniques are not intended to be limited thereto and that these techniques may be applied to other types of stimulation treatments, e.g., matrix acidizing treatments.

FIG. 1 is a diagram illustrating an example of a well system 100 for performing a multistage stimulation treatment within a hydrocarbon reservoir formation. As shown in the example of FIG. 1, well system 100 includes a wellbore 102 in a subsurface formation 104 beneath a surface 106 of the wellsite. Wellbore 102 as shown in the example of FIG. 1 includes a horizontal portion. However, it should be appreciated that embodiments are not limited thereto and that well system 100 may include any combination of horizontal, vertical, slant, curved, and/or other wellbore orientations. The subsurface formation 104 in this example may include a reservoir that contains hydrocarbon resources, such as oil, natural gas, and/or others. For example, the subsurface formation 104 may be a rock formation (e.g., shale, coal, sandstone, granite, and/or others) that includes hydrocarbon deposits, such as oil and natural gas. In some cases, the subsurface formation 104 may be a tight gas formation that includes low permeability rock (e.g., shale, coal, and/or others). The subsurface formation 104 may be composed of naturally fractured rock and/or natural rock formations that are not fractured to any significant degree.

Well system 100 also includes a fluid injection system 108 for injecting treatment fluid, e.g., hydraulic fracturing fluid, into the subsurface formation 104 over multiple sections 118*a*, 118*b*, 118*c*, 118*d*, and 118*e* (collectively referred to herein as "sections 118") of the wellbore 102, as will be described in further detail below. Each of the sections 118 may correspond to, for example, a different stage or interval of the multistage stimulation treatment. The boundaries of the respective sections 118 and corresponding treatment stages/intervals along the length of the wellbore 102 may be delineated by, for example, the locations of bridge plugs, packers and/or other types of equipment in the wellbore 102. Additionally or alternatively, the sections 118 and corresponding treatment stages may be delineated by particular features of the subsurface formation 104. Although five sections are shown in FIG. 1, it should be appreciated that any number of sections and/or treatment stages may be used as desired for a particular implementation. Furthermore, each of the sections 118 may have different widths or may be uniformly distributed along the wellbore 102.

As shown in FIG. 1, injection system 108 includes an injection control subsystem 111, a signaling subsystem 114 installed in the wellbore 102, and one or more injection tools 116 installed in the wellbore 102. The injection control subsystem 111 can communicate with the injection tools 116 from a surface 110 of the wellbore 102 via the signaling subsystem 114. Although not shown in FIG. 1, injection system 108 may include additional and/or different features for implementing the flow distribution monitoring and diversion control techniques disclosed herein. For example, the injection system 108 may include any number of computing subsystems, communication subsystems, pumping subsystems, monitoring subsystems, and/or other features as desired for a particular implementation. In some implementations, the injection control subsystem 111 may be communicatively coupled to a remote computing system (not shown) for exchanging information via a network for purposes of monitoring and controlling wellsite operations, including operations related to the stimulation treatment. Such a network may be, for example and without limitation, a local area network, medium area network, and/or a wide area network, e.g., the Internet.

During each stage of the stimulation treatment, the injection system 108 may alter stresses and create a multitude of fractures in the subsurface formation 104 by injecting the treatment fluid into the surrounding subsurface formation 104 via a plurality of formation entry points along a portion of the wellbore 102 (e.g., along one or more of sections 118). The fluid may be injected through any combination of one or more valves of the injection tools 116. The injection tools 116 may include numerous components including, but not limited to, valves, sliding sleeves, actuators, ports, and/or other features that communicate treatment fluid from a working string disposed within the wellbore 102 into the subsurface formation 104 via the formation entry points. The formation entry points may include, for example, open-hole sections along an uncased portion of the wellbore path, a cluster of perforations along a cased portion of the wellbore path, ports of a sliding sleeve completion device along the wellbore path, slots of a perforated liner along the wellbore path, or any combination of the foregoing.

The injection tools 116 may also be used to perform diversion in order to adjust the downhole flow distribution of the treatment fluid across the plurality of formation entry points. Thus, the flow of fluid and delivery of diverter material into the subsurface formation 104 during the stimulation treatment may be controlled by the configuration of the injection tools 116. The diverter material injected into the subsurface formation 104 may be, for example, a degradable polymer. Examples of different degradable polymer materials that may be used include, but are not limited to, polysaccharides; lignosulfonates; chitins; chitosans; proteins; proteinous materials; fatty alcohols; fatty esters; fatty acid salts; aliphatic polyesters; poly(lactides); poly(glycolides); poly(ε-caprolactones); polyoxymethylene; polyurethanes; poly(hydroxybutyrates); poly(anhydrides); aliphatic polycarbonates; polyvinyl polymers; acrylic-based polymers; poly(amino acids); poly(aspartic acid); poly(alkylene oxides); poly(ethylene oxides); polyphosphazenes; poly(orthoesters); poly(hydroxy ester ethers); polyether esters; polyester amides; polyamides; polyhydroxyalkanoates; polyethyleneterephthalates; polybutyleneterephthalates; polyethylenenaphthalenates, and copolymers, blends, derivatives, or combinations thereof. However, it should be appreciated that embodiments of the present disclosure are not intended to be limited thereto and that other types of diverter materials may also be used.

In one or more embodiments, the valves, ports, and/or other features of the injection tools 116 can be configured to control the location, rate, orientation, and/or other properties of fluid flow between the wellbore 102 and the subsurface formation 104. The injection tools 116 may include multiple tools coupled by sections of tubing, pipe, or another type of conduit. The injection tools may be isolated in the wellbore 102 by packers or other devices installed in the wellbore 102.

In some implementations, the injection system 108 may be used to create or modify a complex fracture network in the subsurface formation 104 by injecting fluid into portions of the subsurface formation 104 where stress has been altered. For example, the complex fracture network may be created or modified after an initial injection treatment has altered stress by fracturing the subsurface formation 104 at multiple locations along the wellbore 102. After the initial injection treatment alters stresses in the subterranean formation, one or more valves of the injection tools 116 may be selectively opened or otherwise reconfigured to stimulate or re-stimulate specific areas of the subsurface formation 104 along one or more sections 118 of the wellbore 102, taking advantage of the altered stress state to create complex fracture networks. In some cases, the injection system 108 may inject fluid simultaneously for multiple intervals and sections 118 of wellbore 102.

The operation of the injection tools 116 may be controlled by the injection control subsystem 111. The injection control subsystem 111 may include, for example, data processing equipment, communication equipment, and/or other systems that control injection treatments applied to the subsurface formation 104 through the wellbore 102. It should be appreciated that such control systems may be automated to enable the techniques disclosed herein to be performed without any user intervention. Additionally or alternatively, the operation of one or more of these systems may be controlled at least partly based on input from a user via a user interface provided by the injection control subsystem 111, as will be described in further detail below with respect to FIG. 8.

In one or more embodiments, the injection control subsystem 111 may receive, generate, or modify a baseline treatment plan for implementing the various stages of the stimulation treatment along the path of the wellbore 102. The baseline treatment plan may specify a baseline pumping schedule for the treatment fluid injections and diverter deployments over each stage of the stimulation treatment. The baseline treatment plan may also specify initial or predetermined values for relevant parameters of the treatment fluid and diverter to be injected into the subsurface formation 104 during each treatment cycle and diversion phase, respectively, of each stage of the stimulation treatment. The parameters specified by such a baseline plan may include, for example, a predetermined amount of diverter to be injected into the subsurface formation 104 during one or more diversion phases of the stimulation treatment. The predetermined diverter amount in this example may be based on historical data relating to the diverter usage during prior stimulation treatments performed along other wellbores drilled within the same hydrocarbon producing field. Additionally or alternatively, the predetermined diverter amount may be based on the results of a computer simulation performed during a design phase of the treatment. In one or more embodiments, the predetermined diverter amount to be injected into the subsurface formation 104 may be adjusted in real-time during a diversion phase of the stimulation treatment based on the disclosed tortuosity and step-down analysis techniques, as will be described in further detail below.

In one or more embodiments, the injection control subsystem 111 initiates control signals to configure or reconfigure the injection tools 116 and/or other equipment (e.g., pump trucks, etc.) in real time based on the treatment plan or modified version thereof. During operation, the signaling subsystem 114 as shown in FIG. 1 transmits the signals from the injection control subsystem 111 at the wellbore surface 110 to one or more of the injection tools 116 disposed in the wellbore 102. For example, the signaling subsystem 114 may transmit hydraulic control signals, electrical control signals, and/or other types of control signals. The control signals may be reformatted, reconfigured, stored, converted, retransmitted, and/or otherwise modified as needed or desired en route between the injection control subsystem 111 (and/or another source) and the injection tools 116 (and/or another destination). The transmitted signals thereby enable the injection control subsystem 111 to control the operation of the injection tools 116 while the treatment is in progress. Examples of different ways to control the operation of each of the injection tools 116 include, but are not limited to, opening, closing, restricting, dilating, repositioning, reorienting, and/or otherwise manipulating one or more valves of the tool to modify the manner in which treatment fluid, proppant, or diverter is communicated into the subsurface formation 104.

It should be appreciated that the combination of injection valves of the injection tools 116 may be configured or reconfigured at any given time during the stimulation treatment. It should also be appreciated that the injection valves may be used to inject any of various treatment fluids, proppants, and/or diverter materials into the subsurface formation 104. Examples of such proppants include, but are not limited to, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, lightweight particulates, microsphere plastic beads, ceramic microspheres, glass microspheres, manmade fibers, cement, fly ash, carbon black powder, and combinations thereof.

In some implementations, the signaling subsystem 114 transmits a control signal to multiple injection tools, and the control signal is formatted to change the state of only one or a subset of the multiple injection tools. For example, a shared electrical or hydraulic control line may transmit a control signal to multiple injection valves, and the control signal may be formatted to selectively change the state of only one (or a subset) of the injection valves. In some cases, the pressure, amplitude, frequency, duration, and/or other properties of the control signal determine which injection tool is modified by the control signal. In some cases, the pressure, amplitude, frequency, duration, and/or other properties of the control signal determine the state of the injection tool affected by the modification.

In one or more embodiments, the injection tools 116 may include one or more sensors for collecting data relating to downhole operating conditions and formation characteristics along the wellbore 102. Such sensors may serve as real-time data sources for various types of downhole measurements and diagnostic information pertaining to each stage of the stimulation treatment. Examples of such sensors include, but are not limited to, micro-seismic sensors, tiltmeters, pressure sensors, and other types of downhole sensing equipment. The data collected downhole by such sensors may include, for example, real-time measurements and diagnostic data for monitoring the extent of fracture growth and complexity within the surrounding formation along the wellbore 102 during each stage of the stimulation treatment, e.g., corresponding to one or more sections 118.

In one or more embodiments, the injection tools 116 may include fiber-optic sensors for collecting real-time measurements of acoustic intensity or thermal energy downhole during the stimulation treatment. For example, the fiber-optic sensors may be components of a distributed acoustic sensing (DAS), distributed strain sensing, and/or distributed temperature sensing (DTS) subsystems of the injection system 108. However, it should be appreciated that embodiments are not intended to be limited thereto and that the injection tools 116 may include any of various measurement and diagnostic tools. In some implementations, the injection tools 116 may be used to inject particle tracers, e.g., tracer slugs, into the wellbore 102 for monitoring the flow distribution based on the distribution of the injected particle tracers during the treatment. For example, such tracers may have a unique temperature profile that the DTS subsystem of the injection system 108 can be used to monitor over the course of a treatment stage.

In one or more embodiments, the signaling subsystem 114 may be used to transmit real-time measurements and diagnostic data collected downhole by one or more of the aforementioned data sources to the injection control subsystem 111 for processing at the wellbore surface 110. Thus, in the fiber-optics example above, the downhole data collected by the fiber-optic sensors may be transmitted to the injection control subsystem 111 via, for example, fiber optic cables included within the signaling subsystem 114. The injection control subsystem 111 (or data processing components thereof) may use the downhole data that it receives via the signaling subsystem 114 to perform real-time fracture mapping and/or real-time fracturing pressure interpretation using any of various data analysis techniques for monitoring stress fields around hydraulic fractures.

Figure 2:
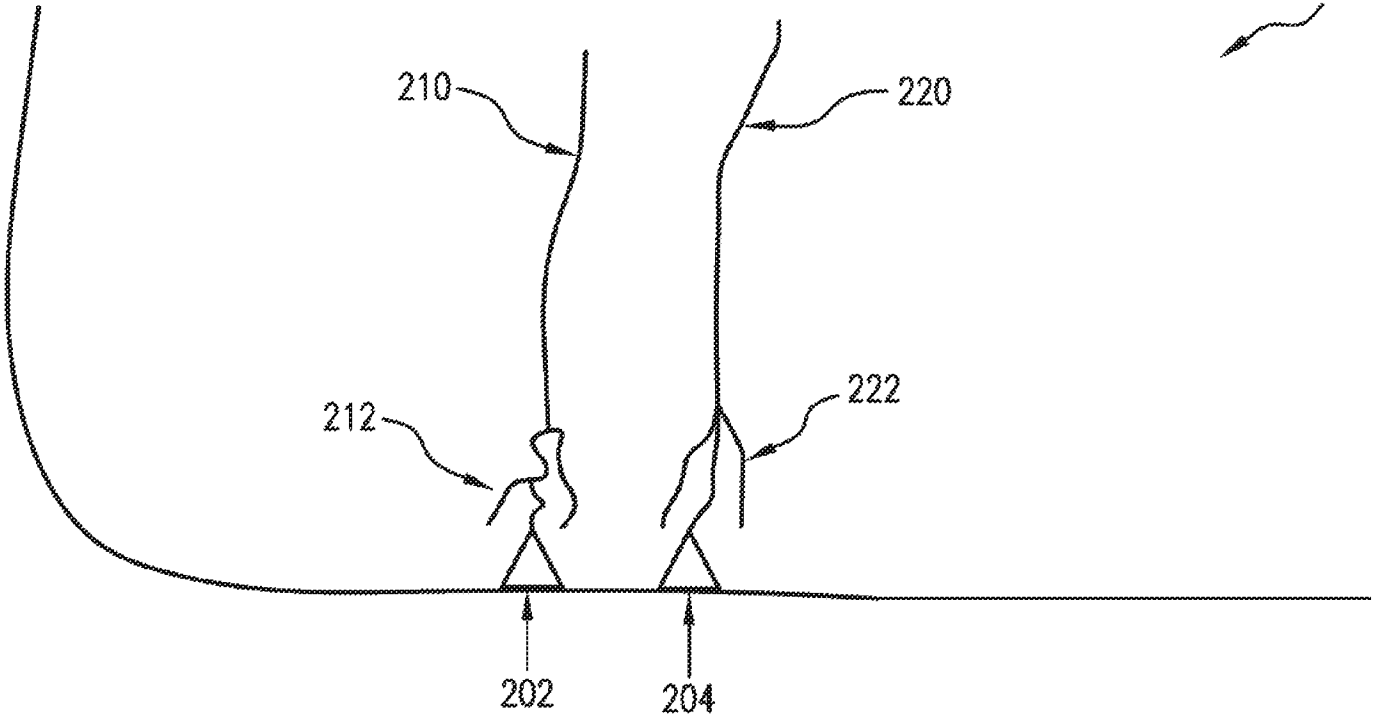
FIG. 2 is a diagram of an illustrative wellbore geometry with tortuous paths connecting fractures along a portion of the wellbore within a subsurface formation.

In one or more embodiments, the data analysis techniques performed by the injection control subsystem 111 may include a step-down analysis for identifying friction due to near-wellbore tortuosity (or "tortuosity friction") and other friction components of a total fracture entry friction along the wellbore 102. Such friction components may affect near-wellbore pressure loss during the stimulation treatment and thus, impact the effectiveness of the treatment along the wellbore 102. In one or more embodiments, the near-wellbore pressure loss may represent a difference between a bottom hole pressure and a bottom hole instantaneous shut-in pressure. Tortuosity friction in particular may be attributed to the path of fractures within the subsurface formation 104 relative to the wellbore's geometry, as shown in FIG. 2. FIG. 2 is a diagram illustrating an example of a wellbore geometry 200 with tortuous paths 212 and 222 connecting fractures 210 and 220, respectively, along a portion of the wellbore within a subsurface formation, e.g., subsurface formation 104 of FIG. 1, as described above. Fractures 210 and 220 in this example may have been formed within the subsurface formation as a result of treatment fluid injected, e.g., by injection tools 116 of FIG. 1, as described above, into formation entry points (or perforation clusters) 202 and 204, respectively, along the wellbore, as shown in FIG. 2. However, it should be appreciated that fractures 210 and 220 may include a combination of man-made and natural fractures. It should also be appreciated that while not shown in FIG. 2, fractures 210 and 220 may be a part of a fracture network within the subsurface formation.

As will be described in further detail below, the friction components identified from the step-down analysis along with other relevant parameters of the treatment design and subsurface formation may be used to estimate or determine an appropriate or optimal amount of diverter to be injected during a diversion phase of the stimulation treatment. For example, referring back to well system 100 of FIG. 1, the results of the step-down analysis may be used by the injection control subsystem 111 to make real-time adjustments to a baseline pumping schedule with respect to the amount of diverter to be injected into the subsurface formation 104 during a diversion phase of the stimulation treatment along a portion of the wellbore 102. The diversion phase in this example may be performed according control signals transmitted by the injection control subsystem 111 to the injection tools 116. The control signals may be used to specify the amount of diverter to be injected into corresponding formation entry points by the injection tools 116 downhole. Additional details regarding the disclosed techniques for controlling diversion during stimulation treatments in real time will be described in further detail below with respect to FIGS. 3-7.

Figure 3:
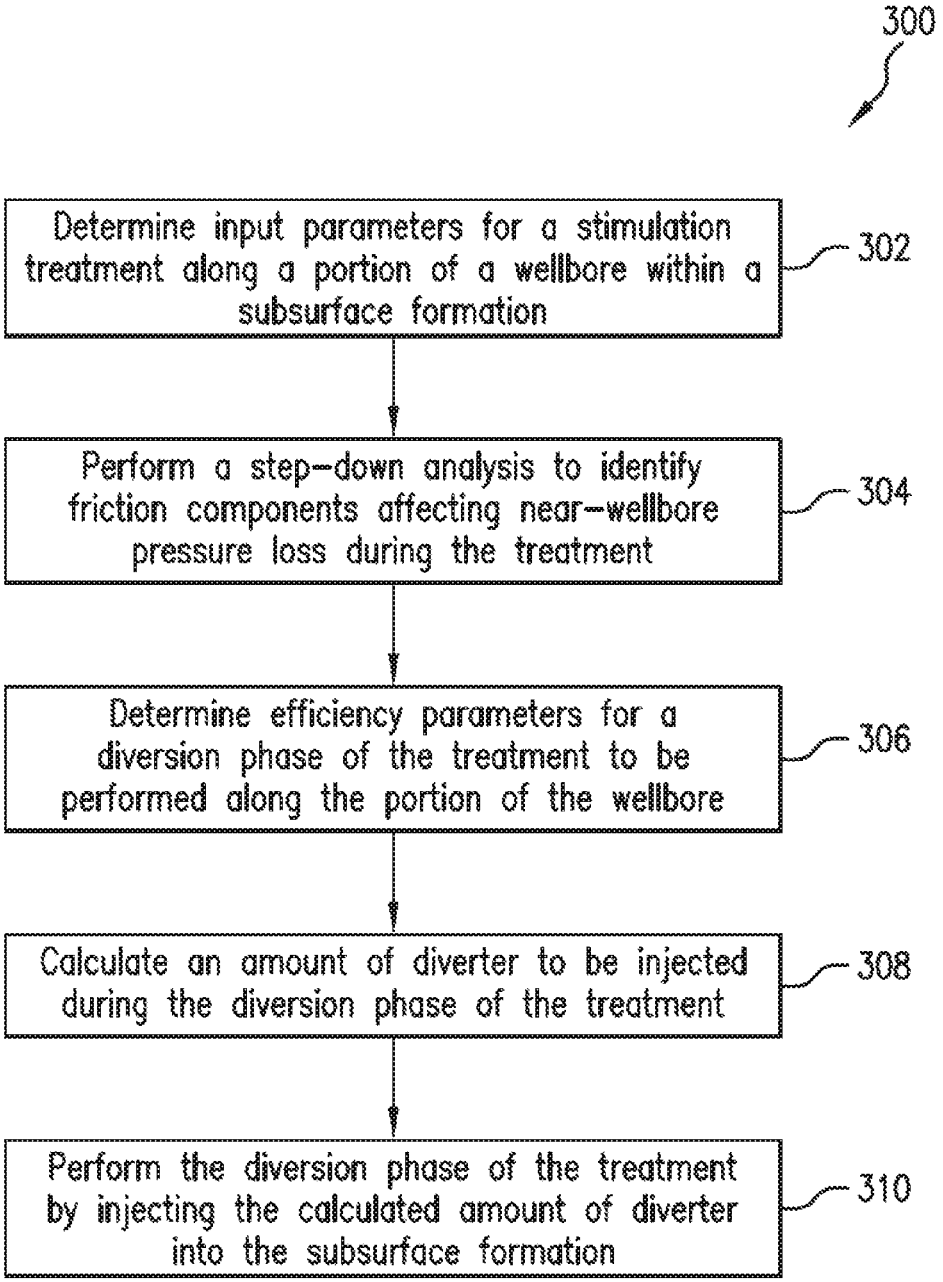
FIG. 3 is a flowchart of an illustrative process of estimating a diverter amount for a stimulation treatment in real time.

FIG. 3 is a flowchart of an illustrative process 300 of controlling diversion for stimulation treatments in real time. For discussion purposes, process 300 will be described using well system 100 of FIG. 1, as described above, but is not intended to be limited thereto. For example, process 300 may be performed by injection control subsystem 111 of the well system 100 in FIG. 1, as described above. Accordingly, the stimulation treatment in this example may be a multi-stage stimulation treatment, e.g., a multistage hydraulic fracturing treatment. Each stage of the treatment may be conducted along a portion of a wellbore path within a subsurface formation, e.g., one or more sections 118 of the wellbore 102 within subsurface formation 104 of FIG. 1, as described above. The subsurface formation may be, for example, tight sand, shale, or other type of rock formation with unconventional reservoirs of trapped hydrocarbon deposits, e.g., oil and/or natural gas. The subsurface formation or portion thereof may be targeted as part of a treatment plan for stimulating the production of such resources from the rock formation. Accordingly, process 300 may be used, for example, to appropriately adjust the treatment plan with respect to the amount of diverter to be injected during a diversion phase of the stimulation treatment in real-time so as to improve the downhole flow distribution of the injected treatment fluid over each stage of the treatment.

As shown in FIG. 3, process 300 starts at block 302, which includes determining input parameters for the stimulation treatment being performed along a wellbore within a subsurface formation. Examples of such input parameters include, but are not limited to, a fluid injection rate, a bottom hole pressure, a total number of proppant cycles, a total mass of proppant injected during the proppant cycles, an average porosity of the subsurface formation, and a completion type. In some implementations, values for such input parameters may be specified as part of a baseline treatment plan or pumping schedule associated with the stimulation treatment, as described above.

In block 304, a step-down analysis is performed to identify friction components of a total fracture entry friction affecting near-wellbore pressure loss during the stimulation treatment. In one or more embodiments, the friction components may include a tortuosity friction and a perforation friction along the portion of the wellbore. The friction components identified in block 304 along with the input parameters from block 302 are used in block 306 to determine efficiency parameters for a diversion phase of the stimulation treatment to be performed along a portion of the wellbore.

In one or more embodiments, near-wellbore pressure loss (NWBPL) may be determined by fitting data to a predefined model, e.g., as expressed by Equation (1):

$$\text{NWBPL}=aQ^x+bQ^2 \tag{1}$$

where the first term ($aQ^x$) represents the tortuosity friction, the second term ($bQ^2$) represents the perforation friction, Q is the flow rate or fluid injection rate, a is the tortuosity constant, and b is the perforation constant. A regression analysis may be performed to fit data relating to the NWBPL and flow rate (Q) to a second order polynomial in order to determine values for constants a and b. The value of the perforation constant b may be used, for example, to estimate the number of open perforations using Equation (2) as follows:

$$b = \frac{0.2369Q^2\rho}{N_p^2C_d^2D^4} \tag{2}$$

where ρ is the density of the treatment fluid, $N_P$ is the number of open perforations, $C_D$ is the discharge coefficient, and D is the diameter of the perforations.

In one or more embodiments, the efficiency parameters may include a perforation efficiency and a diverter efficiency. The perforation efficiency may be determined in block 306 based on a count of open perforations (PerforationsOpen) relative to a total count of perforations (PerforationsShot) along the portion of the wellbore, e.g., as expressed by Equation (3):

$$PerforationEfficiency = \frac{PerforationsOpen}{PerforationsShot} \tag{3}$$

The count or number of open perforations may be estimated based on the perforation friction identified in block 304. The total count of perforations may be one of the input parameters of the stimulation treatment as determined in block 302. The diverter efficiency may be determined in block 306 based on the completion type used for the stimulation treatment, e.g., as determined in block 302. In one or more embodiments, the diverter efficiency may be set to a predetermined value depending on whether the completion type is cemented or uncemented. For example, the diverter efficiency may be set to 100% if the completion type is cemented or 50% otherwise.

Process 300 then proceeds to block 308, which includes calculating an amount of diverter to be injected during the diversion phase of the stimulation treatment, based at least partly on the efficiency parameters. In block 310, the diversion phase of the stimulation treatment is performed by injecting the calculated amount of diverter into the subsurface formation via perforations along the portion of the wellbore. In one or more embodiments, the diverter amount may be calculated using either tortuosity or step-down analysis techniques, as will be described in further detail below with respect to FIGS. 4 and 5, respectively.

Figure 4:
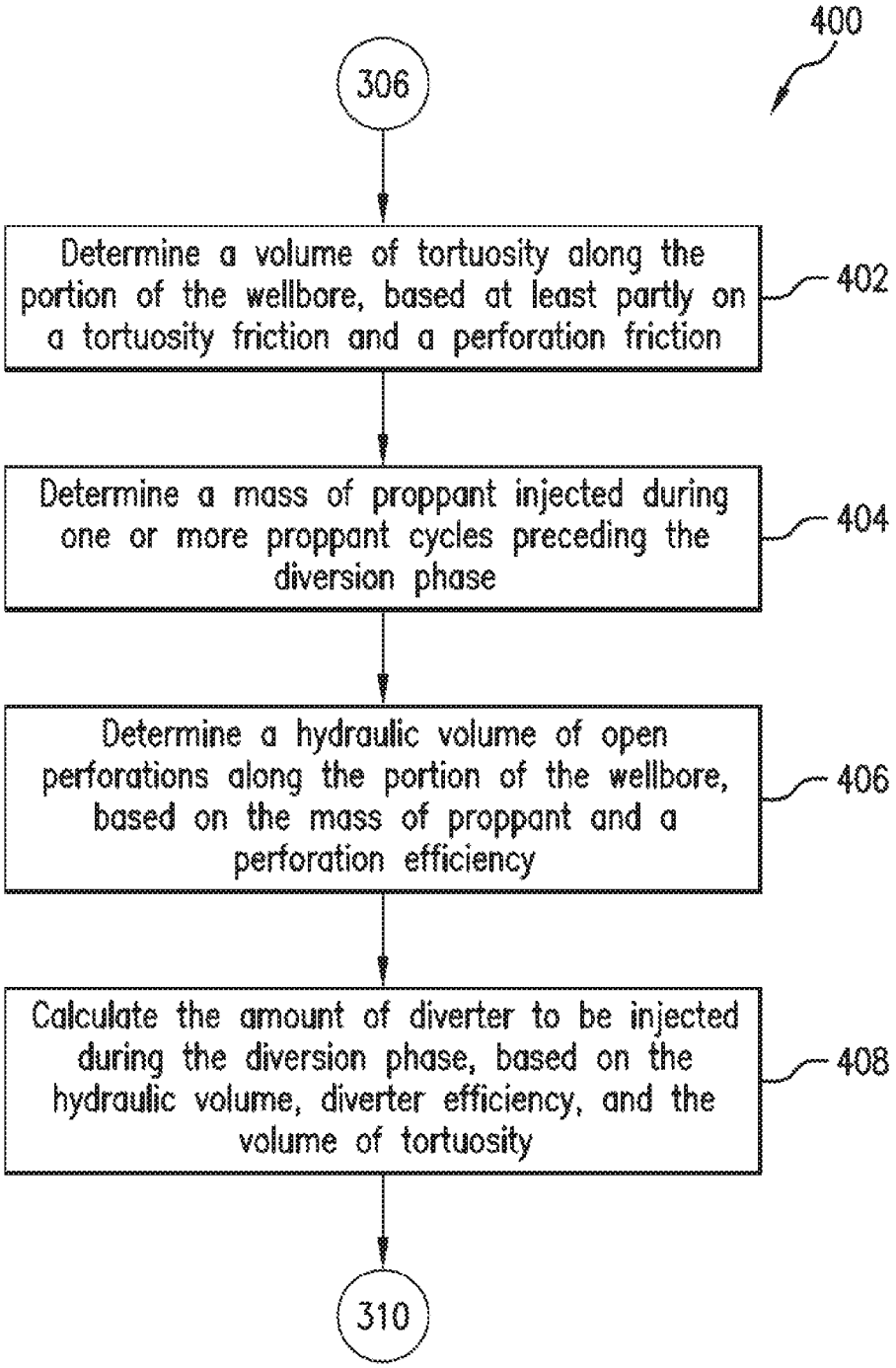
FIG. 4 is a flowchart of an illustrative process for calculating the diverter amount during the stimulation treatment of FIG. 3 based on tortuosity and friction components affecting near-wellbore pressure loss during the stimulation treatment.

FIG. 4 is a flowchart of an illustrative process 400 for calculating the diverter amount during the stimulation treatment of FIG. 3 based on tortuosity and perforation friction components affecting near-wellbore pressure loss during the stimulation treatment. Like process 300 of FIG. 3, process 400 may be performed by injection control subsystem 111 of FIG. 1, as described above. However, process 400 is not intended to be limited thereto. As shown in FIG. 4, process 400 may be used to calculate the diverter amount in block 308 of process 300 of FIG. 3, as described above.

Process 400 starts at block 402, in which a volume of tortuosity along the portion of the wellbore is determined based at least partly on a tortuosity friction and a perforation friction. As described above, the tortuosity friction and the perforation friction may be friction components identified from the step-down analysis performed in block 304 of process 300 of FIG. 3. The tortuosity friction and the perforation friction may be used in block 402 to estimate tortuosity along the portion of the wellbore. The estimated tortuosity may then be used to determine an average porosity of the subsurface formation along the portion of the wellbore, and the average porosity may be used to determine the volume of tortuosity.

In one or more embodiments, the average porosity may be determined in block 402 based on an existing model of the relation between tortuosity and porosity, e.g., as expressed by Equation (4):

$$\tau=1-p\ln\phi \tag{4}$$

where p is a fitting parameter having a predefined value (e.g., 0.77), τ is the near-wellbore tortuosity (or tortuosity friction) and ϕ is the average porosity of the subsurface formation.

As total fracture entry friction is a combination of perforation friction and near-wellbore tortuosity (or tortuosity friction), the near-wellbore tortuosity may be defined by Equation (5) as follows:

$$\tau = \frac{\eta_{Total}}{\eta_{Perffriction}} \tag{5}$$

where $\eta_{Total}$ represents the total fracture entry friction and $\eta_{perffriction}$ represents the perforation friction.

The average porosity may be defined by Equation (6) as follows:

$$\phi = \frac{\phi_{formation}\left(N_{PFC}\pi\left(\frac{R}{\tau}\right)^2 L_{Cluster} - V_{tortuosity}\right) + V_{tortuosity}}{N_{PFC}\pi\left(\frac{R}{\tau}\right)^2 L_{Cluster}} \tag{6}$$

where R is a radius of curvature, $N_{PFC}$ represents the number of perforation clusters along the portion of the wellbore, $L_{Cluster}$ represents the length of each cluster, and $V_{tortuosity}$ represents the volume of tortuosity to be determined. The radius of curvature in Equation (5) above may represent a tortuous geometry of fractures, e.g., fractures 210 and 220 of FIG. 2, as described above, near the portion of the wellbore. Accordingly, the volume of tortuosity may be determined in block 402 based on the radius of curvature and the average porosity of the subsurface formation along the portion of the wellbore.

In one or more embodiments, the radius of curvature (R) may be calculated based on various stress factors affecting the tortuous fracture geometry within the subsurface formation surrounding the portion of the wellbore. Examples of such stress factors include, but are not limited to, the fluid injection rate, a fluid viscosity, and a stress ratio of maximum to minimum stresses affecting the tortuous fracture geometry near the portion of the wellbore. The radius of curvature (R) may be expressed using Equation (7) as follows:

$$R = \frac{1}{2\pi}\left[\frac{3K_I}{\sigma(k-1)}\right]^2 \tag{7}$$

where $K_I$ is a stress intensity factor, $\sigma$ represents the minimum principal stresses, and k is the ratio of maximum to minimum principal stress.

In block 404, the mass of proppant injected during one or more proppant cycles preceding the diversion phase to be performed is determined. The determination in block 404 may be based on, for example, the total number of proppant cycles to be performed for the stimulation treatment and the total mass of proppant to be injected during the proppant cycles.

The total number of proppant cycles and total mass of proppant may be input parameters determined for the stimulation treatment, e.g., from block 302 of process 300 in FIG. 3, as described above.

In block 406, a hydraulic volume of the open perforations along the portion of the wellbore is determined based on the mass of proppant injected during the one or more preceding proppant cycles and the perforation efficiency (e.g., as determined in block 306 of process 300 in FIG. 3, as described above). Process 400 then proceeds to block 408, in which the amount (M) of diverter to be injected during the diversion phase is calculated based on the hydraulic volume of the open perforations, the diverter efficiency, and the volume of tortuosity along the portion of the wellbore, e.g., as expressed by Equation (8):

$$M = \frac{(\text{Number of open perfs} * (\text{Volume of Perf}) + V_{tortuosity})\ \rho_{diverter}}{\text{Diverter Efficiency}} \tag{8}$$

where $\rho_{driver}$ is a density of the diverter to be injected.

Figure 5:
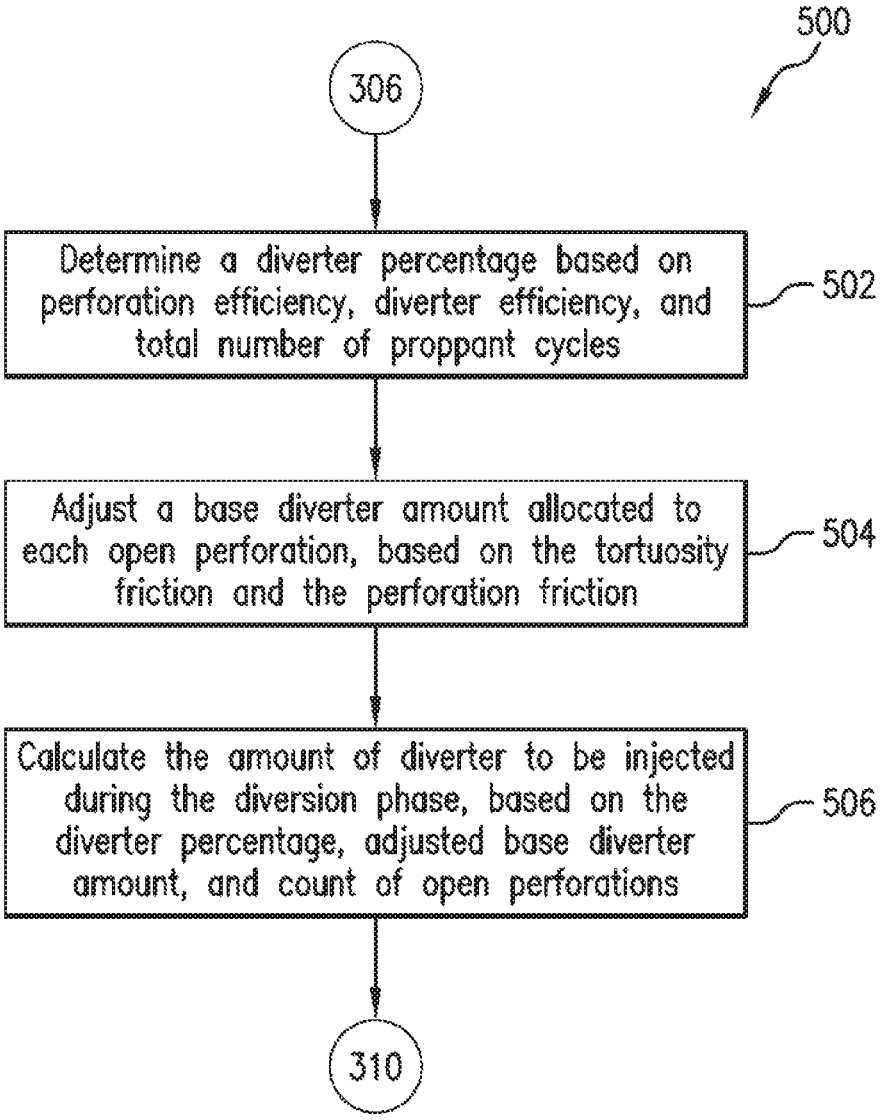
FIG. 5 is a flowchart of another illustrative process for calculating the diverter amount during the stimulation treatment of FIG. 3 based on the friction components and step-down analysis.

FIG. 5 is a flowchart of another illustrative process 500 for calculating the diverter amount during the stimulation treatment of FIG. 3. For example, process 500 may be used in place of process 400 of FIG. 4 to calculate the amount of diverter to be injected in block 308 of process 300 of FIG. 3, as described above. Like process 300 of FIG. 3 and process 400 of FIG. 4, process 500 may be performed by the injection control subsystem 111 of FIG. 1, as described above. However, process 500 is not intended to be limited thereto. Also, like process 400, the amount of diverter may be calculated based partly on the friction components, e.g., the perforation friction and the tortuosity friction, affecting near-wellbore pressure loss during the stimulation treatment along a corresponding portion of the wellbore. However, unlike process 400, process 500 relies on step-down analysis techniques rather than tortuosity to perform the calculation.

Process 500 starts at block 502, in which a diverter percentage is determined based on perforation efficiency (block 306 of FIG. 3), diverter efficiency (block 306 of FIG. 3), and the total number of proppant cycles (block 302 of FIG. 3), e.g., using Equation (9) as follows:

$$Diverter\,\% = \frac{1}{PerforationsEfficiency * ProppantCycles * DiverterEfficiency} \tag{9}$$

In block 504, an initial or base diverter amount, e.g., according to a baseline treatment plan or pumping schedule, is adjusted based on the tortuosity friction and the perforation friction, e.g., using Equation (10):

$$AdjustedDiverter = BaseDiverterLoad + \left(1 - \frac{TortuosityFriction}{(Tortuosityfriction + PerfFriction)}\right) * 5 \tag{10}$$

The BaseDiverterLoad in Equation (10) above may represent the base amount of diverter allocated to each open perforation along the portion of the wellbore in this example. This amount may be set to a predetermined value depending on whether or not the perforation efficiency meets or exceeds a given threshold efficiency (e.g., 50%). For example, the value of BaseDiverterLoad may be set to 8 pounds (lbs.) if the perforation efficiency is determined to be greater than 50% or 15 lbs. otherwise.

Process 500 then proceeds to block 506, in which the total amount of diverter to be injected during the diversion phase is calculated based on the count of open perforations (e.g., as estimated in block 306 of FIG. 3, as described above) along with the diverter percentage and the adjusted base diverter amount from blocks 502 and 504, respectively, e.g., using Equations (11) and (12):

$$\text{(if PerfEfficiency}>T\text{)}\quad \text{TotalDiverter}=\text{AdjustedDiverter}\times\text{OpenPerfCount} \tag{11}$$

$$\text{(if PerfEfficiency}\leq(T)\quad \text{TotalDiverter}=\text{AdjustedDiverter}\times\text{OpenPerf-Cointx Diverter \%} \tag{12}$$

where T is the threshold efficiency and Equation (11) is used to calculate the total amount of diverter only when the perforation efficiency is determined to be greater than T. Otherwise, Equation (12) is used.

Figure 6:
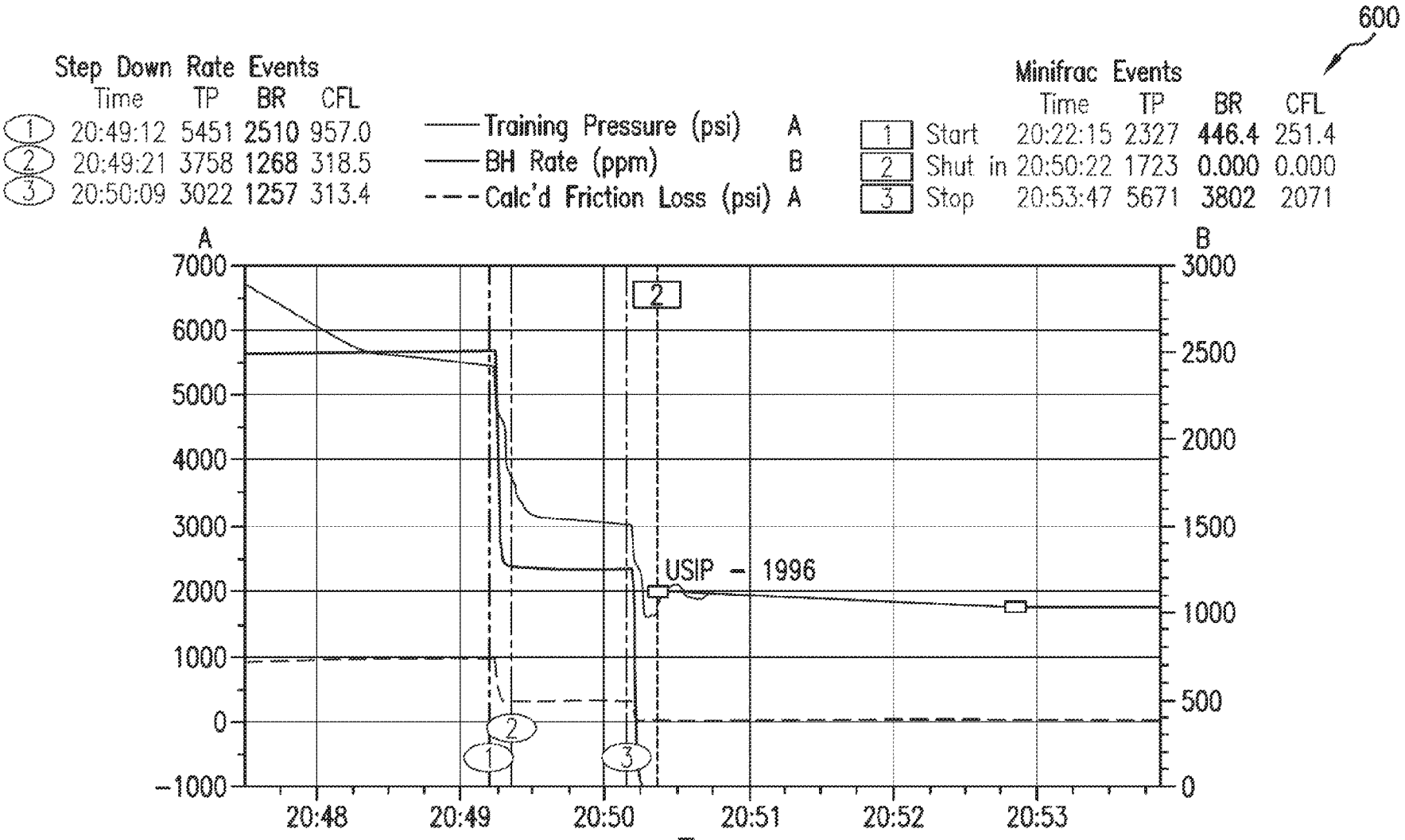
FIG. 6 is a plot graph showing the results of an illustrative step-down analysis for identifying the friction components of a total fracture entry friction affecting near-wellbore pressure loss during a stimulation treatment.
Figure 7:
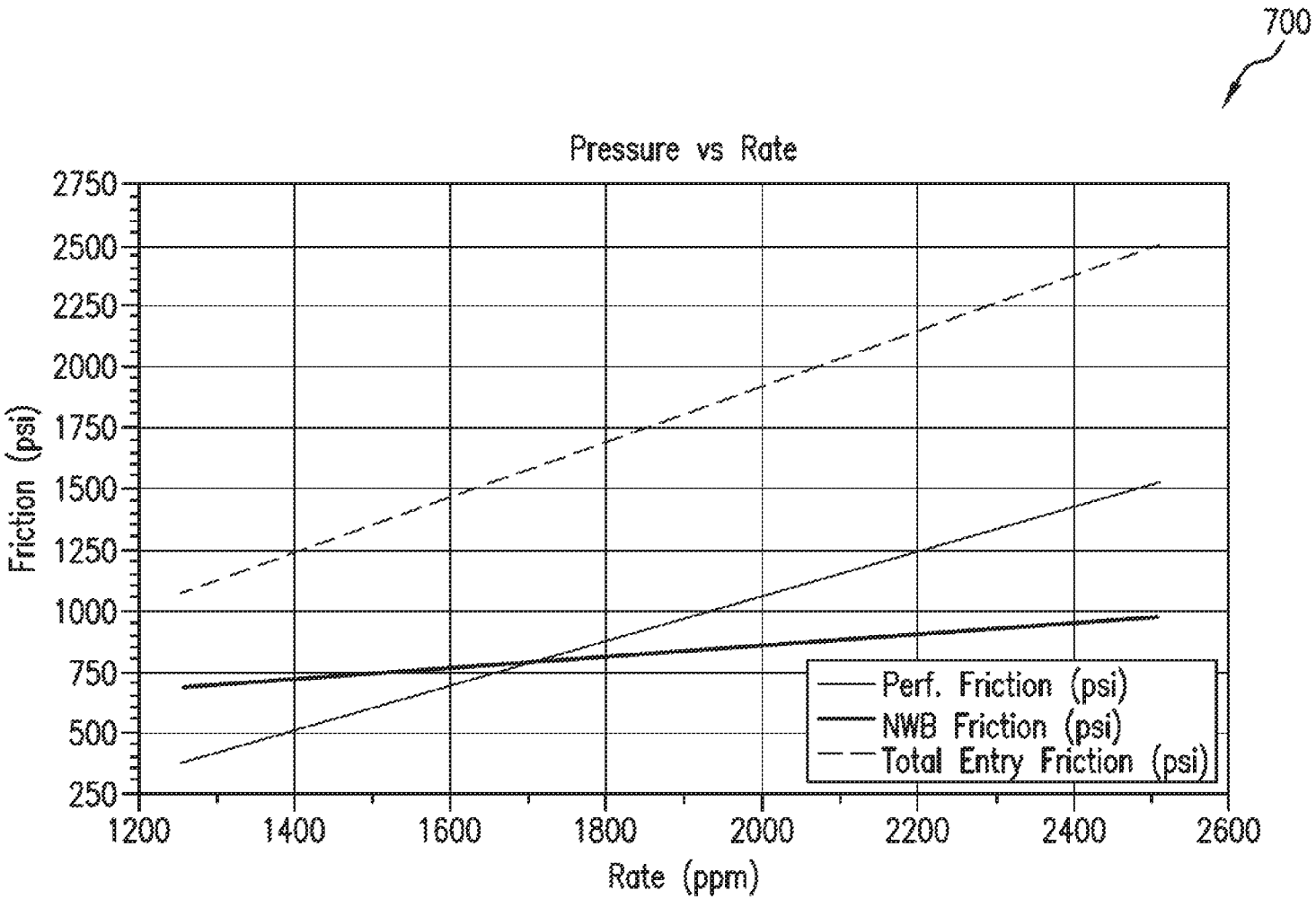
FIG. 7 is a plot graph of the friction components identified from the step-down analysis of FIG. 6.

To help further describe embodiments of the present disclosure, FIGS. 6-7 will be used to demonstrate an example of a practical application of the real-time analysis and diversion control techniques described above with respect to processes 300, 400, and 500 of FIGS. 3, 4, and 5, respectively. For proposes of this example, it is assumed that a diversion phase of the stimulation treatment will be performed along a wellbore having a single casing section with a length of 9,144 feet, an outer diameter of 7 inches, and an inner diameter of 6.184 inches. The diversion phase may be performed along a portion of the wellbore where some number of perforation clusters (e.g., six perforation clusters) are located.

As described above, a step-down analysis may be performed to identify the friction components (e.g., tortuosity and performation friction) of a total fracture entry friction affecting near-wellbore pressure loss during the stimulation treatment. The step-down analysis may be performed using any number of step downs (e.g., four step downs) with corresponding step-down rates. FIG. 6 is a plot graph 600 showing the results of such a step-down analysis with four step-down rate events. FIG. 7 is a plot graph 700 illustrating pressure variations due to the friction components identified from the step-down analysis of FIG. 6 relative to the injection or flow rate. Also, as described above, the identified friction components along with selected input parameters of the stimulation treatment may be used to determine efficiency parameters for the diversion phase, which may then be used to calculate the amount of diverter to be injected during the diversion phase.

Table 1 shows the values of different variables that may be determined for the stimulation treatment in this example based on the real-time analysis and diversion control techniques described above. e.g., using process 300 of FIG. 3 and processes 400 or 500 of FIGS. 4 and 5, respectively:

TABLE 1

| Variable | Estimated Value |
|---|---|
| Tortuosity Friction (Step down) | 975 Psi |
| Perforation Friction (Step down) | 1524 Psi |
| Tortuosity | 1.63976 |
| Average Porosity | 0.435674 |
| Critical Stress Intensity | 1.5e6 Pa $m^{0.5}$ |
| Minimum Horizontal Stress | 3.37e7 Pa |
| Maximum Horizontal Stress | 3.71e7 Pa |
| Number of Open Perforations (Step Down) | 19.1 |
| Diameter of Perforation | 0.01 m |
| Length of Perforation | 0.1 m |
| Density of Diverter | 1100 $kg/m^3$ |
| Diverter Efficiency | 1 |
| Radius of Curvature | 0.411 m |
| Formation Porosity | 0.2 |
| Total Number of Perforations | 54 |
| Number of Clusters | 9 |
| Cluster Length | 0.3048 m |
| Tortuous Volume | 0.1596 $m^3$ |

TABLE 1-continued

| Variable | Estimated Value |
|---|---|
| Diverter Amount (Calculated) | 178 lbs. |
| Diverter Amount (Actual) | 165 lbs |

The last two rows of Table 1 above show a comparison between the calculated diverter amount using the disclosed techniques and the actual diverter amount that was shown by empirical analysis to be required to effectively plug perforations and adjust the flow distribution to a desired level along the portion of the wellbore. In particular, this comparison shows only a 10% deviation between the calculated diverter amount and the actual diverter amount that was required for the diversion to be effective.

Figure 8:
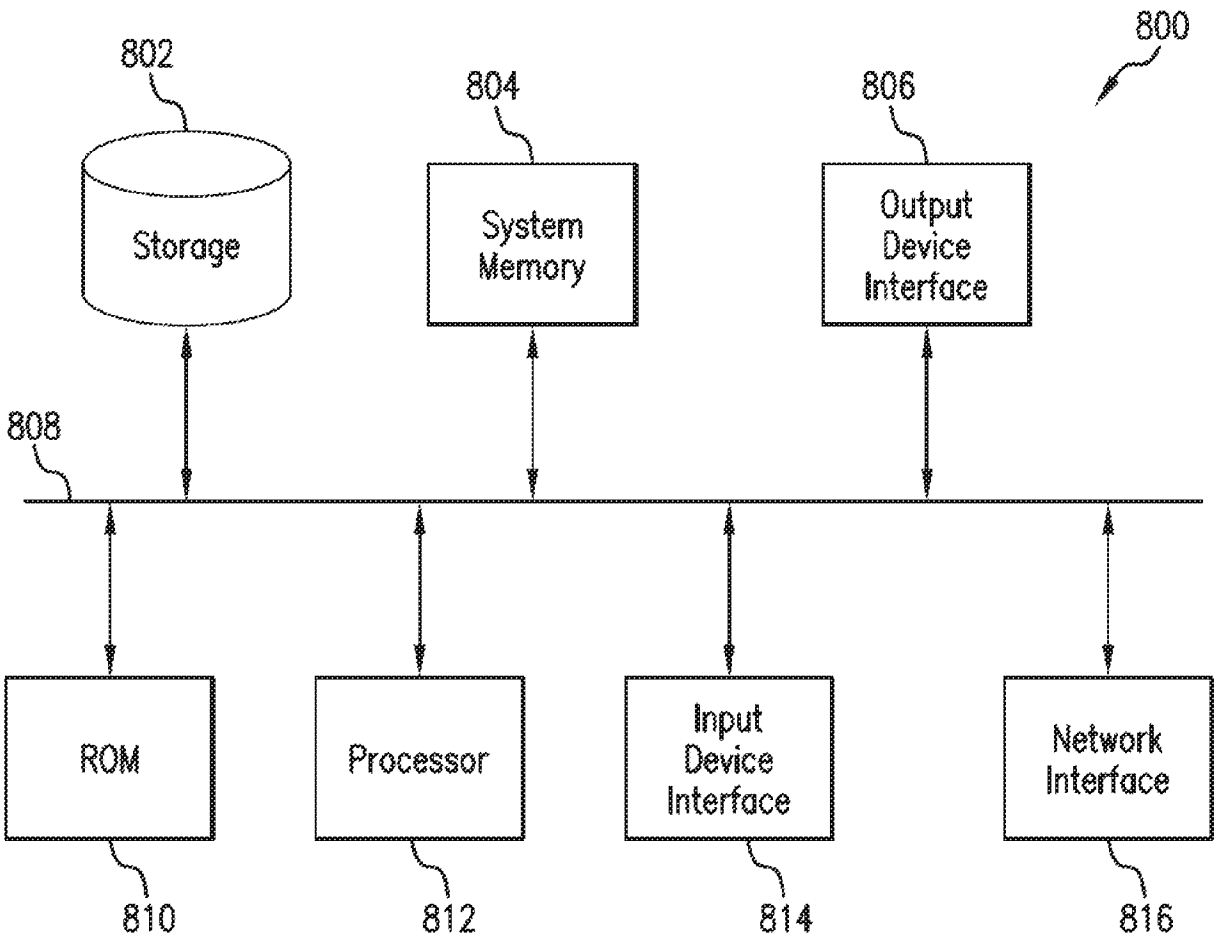
FIG. 8 is a block diagram of an illustrative computer system in which embodiments of the present disclosure may be implemented.

FIG. 8 is a block diagram of an illustrative computer system 800 in which embodiments of the present disclosure may be implemented. For example, the steps of processes 300, 400, and 500 of FIGS. 3, 4, and 5, respectively, as described above, may be performed using system 800. Further, system 800 may be used to implement, for example, the injection control subsystem 111 (or data processing components thereof) of FIG. 1, as described above. System 800 can be any type of electronic computing device or cluster of such devices, e.g., as in a server farm. Examples of such a computing device include, but are not limited to, a server, workstation or desktop computer, a laptop computer, a tablet computer, a mobile phone, a personal digital assistant (PDA), a set-top box, or similar type of computing device. Such an electronic device includes various types of computer readable media and interfaces for various other types of computer readable media. As shown in FIG. 8, system 800 includes a permanent storage device 802, a system memory 804, an output device interface 806, a system communications bus 808, a read-only memory (ROM) 810, processing unit(s) 812, an input device interface 814, and a network interface 816.

Bus 808 collectively represents all system, peripheral, and chipset buses that communicatively connect the numerous internal devices of system 800. For instance, bus 808 communicatively connects processing unit(s) 812 with ROM 810, system memory 804, and permanent storage device 802.

From these various memory units, processing unit(s) 812 retrieves instructions to execute and data to process in order to execute the processes of the subject disclosure. The processing unit(s) can be a single processor or a multi-core processor in different implementations.

ROM 810 stores static data and instructions that are needed by processing unit(s) 812 and other modules of system 800. Permanent storage device 802, on the other hand, is a read-and-write memory device. This device is a non-volatile memory unit that stores instructions and data even when system 800 is off. Some implementations of the subject disclosure use a mass-storage device (such as a magnetic or optical disk and its corresponding disk drive) as permanent storage device 802.

Other implementations use a removable storage device (such as a floppy disk, flash drive, and its corresponding disk drive) as permanent storage device 802. Like permanent storage device 802, system memory 804 is a read-and-write memory device. However, unlike storage device 802, system memory 804 is a volatile read-and-write memory, such a random access memory. System memory 804 stores some of the instructions and data that the processor needs at runtime. In some implementations, the processes of the subject disclosure are stored in system memory 804, permanent storage device 802, and/or ROM 810. For example, the various memory units include instructions for performing the real-time analysis and diversion control techniques disclosed herein. From these various memory units, processing unit(s) 812 retrieves instructions to execute and data to process in order to execute the processes of some implementations.

Bus 808 also connects to input and output device interfaces 814 and 806. Input device interface 814 enables the user to communicate information and select commands to the system 800. Input devices used with input device interface 814 include, for example, alphanumeric, QWERTY, or T9 keyboards, microphones, and pointing devices (also called "cursor control devices"). Output device interfaces 806 enables, for example, the display of images generated by the system 800. Output devices used with output device interface 806 include, for example, printers and display devices, such as cathode ray tubes (CRT) or liquid crystal displays (LCD). Some implementations include devices such as a touchscreen that functions as both input and output devices. It should be appreciated that embodiments of the present disclosure may be implemented using a computer including any of various types of input and output devices for enabling interaction with a user. Such interaction may include feedback to or from the user in different forms of sensory feedback including, but not limited to, visual feedback, auditory feedback, or tactile feedback. Further, input from the user can be received in any form including, but not limited to, acoustic, speech, or tactile input. Additionally, interaction with the user may include transmitting and receiving different types of information, e.g., in the form of documents, to and from the user via the above-described interfaces.

Also, as shown in FIG. 8, bus 808 also couples system 800 to a public or private network (not shown) or combination of networks through a network interface 816. Such a network may include, for example, a local area network ("LAN"), such as an Intranet, or a wide area network ("WAN"), such as the Internet. Any or all components of system 800 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself. Accordingly, the steps of processes 300, 400, and 500 of FIGS. 3, 4, and 5, respectively, as described above, may be implemented using system 800 or any computer system having processing circuitry or a computer program product including instructions stored therein, which, when executed by at least one processor, causes the processor to perform functions relating to these methods.

As used in this specification and any claims of this application, the terms "computer", "server", "processor", and "memory" all refer to electronic or other technological devices. These terms exclude people or groups of people. As used herein, the terms "computer readable medium" and "computer readable media" refer generally to tangible, physical, and non-transitory electronic storage mediums that store information in a form that is readable by a computer.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., a web page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

As described above, embodiments of the present disclosure are particularly useful for controlling diversion during stimulation treatments in real time. In an embodiment of the present disclosure, a method of controlling diversion for stimulation treatments in real time includes: determining input parameters for a stimulation treatment being performed along a wellbore within a subsurface formation, the input parameters including selected treatment design parameters and formation parameters; performing a step-down analysis to identify friction components of a total fracture entry friction affecting near-wellbore pressure loss during the stimulation treatment; determining efficiency parameters for a diversion phase of the stimulation treatment to be performed along a portion of the wellbore, based on the input parameters and the friction components; calculating an amount of diverter to be injected during the diversion phase of the stimulation treatment, based at least partly on the efficiency parameters; and performing the diversion phase of the stimulation treatment by injecting the calculated amount of diverter into the subsurface formation via perforations along the portion of the wellbore. Further, a computer-readable storage medium with instructions stored therein has been described, where the instructions when executed by a computer cause the computer to perform a plurality of functions, including functions to: determine input parameters for a stimulation treatment being performed along a wellbore within a subsurface formation, the input parameters including selected treatment design parameters and formation parameters; perform a step-down analysis to identify friction components of a total fracture entry friction affecting near-wellbore pressure loss during the stimulation treatment; determine efficiency parameters for a diversion phase of the stimulation treatment to be performed along a portion of the wellbore, based on the input parameters and the friction components; calculate an amount of diverter to be injected during the diversion phase of the stimulation treatment, based at least partly on the efficiency parameters; and perform the diversion phase of the stimulation treatment by injecting the calculated amount of diverter into the subsurface formation via perforations along the portion of the wellbore.

In one or more of the foregoing embodiments, the input parameters include a fluid injection rate, a bottom hole pressure, a total number of proppant cycles, a total mass of proppant injected during the proppant cycles, an average porosity of the subsurface formation, and a completion type. The friction components may include a tortuosity friction and a perforation friction along the portion of the wellbore. The efficiency parameters may include a perforation efficiency and a diverter efficiency. Calculating the amount of diverter may include: determining a diverter percentage based on the perforation efficiency, the diverter efficiency, and the total number of proppant cycles; adjusting a base diverter amount allocated for each open perforation along the portion of the wellbore, based on the tortuosity friction and the perforation friction; and calculating the amount of diverter to be injected during the diversion phase, based on the diverter percentage, the adjusted base diverter amount, and the count of open perforations. In one or more of the foregoing embodiments, the input parameters may further include a total count of the perforations along the portion of the wellbore, and determining the perforation efficiency may include: estimating a count of open perforations along the portion of the wellbore, based on the perforation friction; and determining the perforation efficiency, based on the estimated count of open perforations relative to the total count of the perforations along the portion of the wellbore, and determining the diverter efficiency may include: determining the diverter efficiency based on the completion type. In one or more of the foregoing embodiments, calculating the amount of diverter comprises: determining a volume of tortuosity along the portion of the wellbore, based at least partly on the tortuosity friction and the perforation friction; determining a mass of proppant injected during one or more proppant cycles preceding the diversion phase, based on the total number of proppant cycles, and the total mass of proppant to be injected during the proppant cycles; determining a hydraulic volume of the open perforations along the portion of the wellbore, based on the mass of proppant injected during the one or more preceding proppant cycles and the perforation efficiency; and calculating the amount of diverter to be injected during the diversion phase, based on the hydraulic volume of the open perforations, the diverter efficiency, and the volume of tortuosity along the portion of the wellbore. Determining the volume of tortuosity may comprise: estimating tortuosity along the portion of the wellbore based on the tortuosity friction and the perforation friction; determining an average porosity of the subsurface formation along the portion of the wellbore, based on the estimated tortuosity; determining the volume of tortuosity along the portion of the wellbore, based at least partly on the average porosity; determining stress factors affecting a tortuous fracture geometry within the subsurface formation surrounding the portion of the wellbore; calculating a radius of curvature representing the tortuous fracture geometry near the portion of the wellbore, based on the stress factors; and determining the volume of tortuosity along the portion of the wellbore, based on the radius of curvature and the average porosity of the subsurface formation along the portion of the wellbore. The stress factors may include the fluid injection rate, a fluid viscosity, and a stress ratio of maximum to minimum stresses affecting the tortuous fracture geometry near the portion of the wellbore.

Furthermore, a system has been described, which includes at least one processor and a memory coupled to the processor that has instructions stored therein, which when executed by the processor, cause the processor to perform functions, including functions to: determine input parameters for a stimulation treatment being performed along a wellbore within a subsurface formation, the input parameters including selected treatment design parameters and formation parameters; perform a step-down analysis to identify friction components of a total fracture entry friction affecting near-wellbore pressure loss during the stimulation treatment; determine efficiency parameters for a diversion phase of the stimulation treatment to be performed along a portion of the wellbore, based on the input parameters and the friction components; calculate an amount of diverter to be injected during the diversion phase of the stimulation treatment, based at least partly on the efficiency parameters; and perform the diversion phase of the stimulation treatment by injecting the calculated amount of diverter into the subsurface formation via perforations along the portion of the wellbore.

In one or more embodiments of the foregoing system, the input parameters include a fluid injection rate, a bottom hole pressure, a total number of proppant cycles, a total mass of proppant injected during the proppant cycles, an average porosity of the subsurface formation, and a completion type. The friction components may include a tortuosity friction and a perforation friction along the portion of the wellbore. The efficiency parameters may include a perforation efficiency and a diverter efficiency. Calculating the amount of diverter may include: determining a diverter percentage based on the perforation efficiency, the diverter efficiency, and the total number of proppant cycles; adjusting a base diverter amount allocated for each open perforation along the portion of the wellbore, based on the tortuosity friction and the perforation friction; and calculating the amount of diverter to be injected during the diversion phase, based on the diverter percentage, the adjusted base diverter amount, and the count of open perforations. The input parameters may further include a total count of the perforations along the portion of the wellbore, and determining the perforation efficiency may include: estimating a count of open perforations along the portion of the wellbore, based on the perforation friction; and determining the perforation efficiency, based on the estimated count of open perforations relative to the total count of the perforations along the portion of the wellbore, and determining the diverter efficiency may include: determining the diverter efficiency based on the completion type. In one or more embodiments of the foregoing system, the functions performed by the processor further include functions to: determine a volume of tortuosity along the portion of the wellbore, based at least partly on the tortuosity friction and the perforation friction; determine a mass of proppant injected during one or more proppant cycles preceding the diversion phase, based on the total number of proppant cycles and the total mass of proppant to be injected during the proppant cycles; determine a hydraulic volume of the open perforations along the portion of the wellbore, based on the mass of proppant injected during the one or more preceding proppant cycles and the perforation efficiency; calculate the amount of diverter to be injected during the diversion phase, based on the hydraulic volume of the open perforations, the diverter efficiency, and the volume of tortuosity along the portion of the wellbore; estimate tortuosity along the portion of the wellbore based on the tortuosity friction and the perforation friction; determining an average porosity of the subsurface formation along the portion of the wellbore, based on the estimated tortuosity; determine the volume of tortuosity along the portion of the wellbore, based at least partly on the average porosity; determine stress factors affecting a tortuous fracture geometry within the subsurface formation surrounding the portion of the wellbore, where the stress factors may include the fluid injection rate, a fluid viscosity, and a stress ratio of maximum to minimum stresses affecting the tortuous fracture geometry near the portion of the wellbore; calculate a radius of curvature representing the tortuous fracture geometry near the portion of the wellbore, based on the stress factors; and determine the volume of tortuosity along the portion of the wellbore, based on the radius of curvature and the average porosity of the subsurface formation along the portion of the wellbore.

While specific details about the above embodiments have been described, the above hardware and software descriptions are intended merely as example embodiments and are not intended to limit the structure or implementation of the disclosed embodiments. For instance, although many other internal components of the system 800 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A method of controlling diversion for stimulation treatments in real time, the method comprising:

determining input parameters for a stimulation treatment being performed along a wellbore within a subsurface formation, the input parameters including selected treatment design parameters and formation parameters;

performing a step-down analysis to identify friction components of a total fracture entry friction affecting near-wellbore pressure loss during the stimulation treatment;

determining efficiency parameters for a diversion phase of the stimulation treatment to be performed along a portion of the wellbore, based on the input parameters and the friction components, wherein the efficiency parameters include a perforation efficiency and a diverter efficiency;

calculating an amount of diverter to be injected during the diversion phase of the stimulation treatment, based at least partly on the efficiency parameters; and performing the diversion phase of the stimulation treatment by injecting the calculated amount of diverter into the subsurface formation via perforations along the portion of the wellbore.

2. The method of claim 1, wherein the input parameters include a fluid injection rate, a bottom hole pressure, a total number of proppant cycles, a total mass of proppant injected during the proppant cycles, an average porosity of the subsurface formation, and a completion type.

3. The method of claim 2, wherein the friction components include a tortuosity friction and a perforation friction along the portion of the wellbore.

4. The method of claim 3, wherein the input parameters further include a total count of the perforations along the portion of the wellbore.

5. The method of claim 4, wherein calculating the amount of diverter comprises:

determining a diverter percentage based on the perforation efficiency, the diverter efficiency, and the total number of proppant cycles;

adjusting a base diverter amount allocated for each open perforation along the portion of the wellbore, based on the tortuosity friction and the perforation friction; and calculating the amount of diverter to be injected during the diversion phase, based on the diverter percentage, the adjusted base diverter amount, and the count of open perforations.

6. The method of claim 4, wherein determining the perforation efficiency includes:

estimating a count of open perforations along the portion of the wellbore, based on the perforation friction; and determining the perforation efficiency, based on the estimated count of open perforations relative to the total count of the perforations along the portion of the wellbore, and wherein determining the diverter efficiency comprises:

determining the diverter efficiency based on the completion type.

7. The method of claim 4, wherein calculating the amount of diverter comprises:

determining a volume of tortuosity along the portion of the wellbore, based at least partly on the tortuosity friction and the perforation friction;

determining a mass of proppant injected during one or more proppant cycles preceding the diversion phase, based on the total number of proppant cycles and the total mass of proppant to be injected during the proppant cycles;

determining a hydraulic volume of the open perforations along the portion of the wellbore, based on the mass of proppant injected during the one or more preceding proppant cycles and the perforation efficiency; and calculating the amount of diverter to be injected during the diversion phase, based on the hydraulic volume of the open perforations, the diverter efficiency, and the volume of tortuosity along the portion of the wellbore.

8. The method of claim 7, wherein determining the volume of tortuosity comprises:

estimating tortuosity along the portion of the wellbore based on the tortuosity friction and the perforation friction;

determining an average porosity of the subsurface formation along the portion of the wellbore, based on the estimated tortuosity; and determining the volume of tortuosity along the portion of the wellbore, based at least partly on the average porosity.

9. The method of claim 8, wherein determining the volume of tortuosity further comprises:

determining stress factors affecting a tortuous fracture geometry within the subsurface formation surrounding the portion of the wellbore;

calculating a radius of curvature representing the tortuous fracture geometry near the portion of the wellbore, based on the stress factors; and determining the volume of tortuosity along the portion of the wellbore, based on the radius of curvature and the average porosity of the subsurface formation along the portion of the wellbore.

10. The method of claim 9, wherein the stress factors include the fluid injection rate, a fluid viscosity, and a stress ratio of maximum to minimum stresses affecting the tortuous fracture geometry near the portion of the wellbore.

11. A system comprising:

at least one processor; and a memory coupled to the processor having instructions stored therein, which when executed by the processor, cause the processor to perform a plurality of functions, including functions to:

determine input parameters for a stimulation treatment being performed along a wellbore within a subsurface formation, the input parameters including selected treatment design parameters and formation parameters;

perform a step-down analysis to identify friction components of a total fracture entry friction affecting near-wellbore pressure loss during the stimulation treatment;

determine efficiency parameters for a diversion phase of the stimulation treatment to be performed along a portion of the wellbore, based on the input parameters and the friction components, wherein the efficiency parameters include a perforation efficiency and a diverter efficiency;

calculate an amount of diverter to be injected during the diversion phase of the stimulation treatment, based at least partly on the efficiency parameters; and perform the diversion phase of the stimulation treatment by injecting the calculated amount of diverter into the subsurface formation via perforations along the portion of the wellbore.

12. The system of claim 11, wherein the input parameters include a fluid injection rate, a bottom hole pressure, a total number of proppant cycles, a total mass of proppant injected during the proppant cycles, an average porosity of the subsurface formation, and a completion type, and the friction components include a tortuosity friction and a perforation friction along the portion of the wellbore.

13. The system of claim 12, wherein the functions performed by the processor further include functions to:

determine a diverter percentage based on the perforation efficiency, the diverter efficiency, and the total number of proppant cycles;

adjust a base diverter amount allocated for each open perforation along the portion of the wellbore, based on the tortuosity friction and the perforation friction; and calculate the amount of diverter to be injected during the diversion phase, based on the diverter percentage, the adjusted base diverter amount, and the count of open perforations.

14. The system of claim 12, wherein the input parameters further include a total count of the perforations along the portion of the wellbore, and the functions performed by the processor further include functions to:

estimate a count of open perforations along the portion of the wellbore, based on the perforation friction;

determine the perforation efficiency, based on the estimated count of open perforations relative to the total count of the perforations along the portion of the wellbore; and determine the diverter efficiency based on the completion type.

15. The system of claim 12, wherein the functions performed by the processor further include functions to:

determine a volume of tortuosity along the portion of the wellbore, based at least partly on the tortuosity friction and the perforation friction;

determine a mass of proppant injected during one or more proppant cycles preceding the diversion phase, based on the total number of proppant cycles and the total mass of proppant to be injected during the proppant cycles;

determine a hydraulic volume of the open perforations along the portion of the wellbore, based on the mass of proppant injected during the one or more preceding proppant cycles and the perforation efficiency; and calculate the amount of diverter to be injected during the diversion phase, based on the hydraulic volume of the open perforations, the diverter efficiency, and the volume of tortuosity along the portion of the wellbore.

16. The system of claim 15, wherein the functions performed by the processor further include functions to:

estimate tortuosity along the portion of the wellbore based on the tortuosity friction and the perforation friction;

determine an average porosity of the subsurface formation along the portion of the wellbore, based on the estimated tortuosity; and determine the volume of tortuosity along the portion of the wellbore, based at least partly on the average porosity.

17. The system of claim 16, wherein the functions performed by the processor further include functions to:

determine stress factors affecting a tortuous fracture geometry within the subsurface formation surrounding the portion of the wellbore;

calculate a radius of curvature representing the tortuous fracture geometry near the portion of the wellbore, based on the stress factors; and determine the volume of tortuosity along the portion of the wellbore, based on the radius of curvature and the average porosity of the subsurface formation along the portion of the wellbore.

18. The system of claim 17, wherein the stress factors include the fluid injection rate, a fluid viscosity, and a stress ratio of maximum to minimum stresses affecting the tortuous fracture geometry near the portion of the wellbore.

19. A computer-readable storage medium having instructions stored therein, which when executed by a computer cause the computer to perform a plurality of functions, including functions to:

determine input parameters for a stimulation treatment being performed along a wellbore within a subsurface formation, the input parameters including selected treatment design parameters and formation parameters;

perform a step-down analysis to identify friction components of a total fracture entry friction affecting near-wellbore pressure loss during the stimulation treatment;

determine efficiency parameters for a diversion phase of the stimulation treatment to be performed along a portion of the wellbore, based on the input parameters and the friction components, wherein the efficiency parameters include a perforation efficiency and a diverter efficiency;

calculate an amount of diverter to be injected during the diversion phase of the stimulation treatment, based at least partly on the efficiency parameters; and perform the diversion phase of the stimulation treatment by injecting the calculated amount of diverter into the subsurface formation via perforations along the portion of the wellbore.

20. The computer-readable storage medium of claim 19, wherein the input parameters include a fluid injection rate, a bottom hole pressure, a total number of proppant cycles, a total mass of proppant injected during the proppant cycles, an average porosity of the subsurface formation, and a completion type, and the friction components include a tortuosity friction and a perforation friction along the portion of the wellbore.

* * * * *